US005964538A

United States Patent [19]

Herbert

[11] Patent Number: 5,964,538

[45] Date of Patent: Oct. 12, 1999

[54] THERMAL TRANSFER PRINTING APPARATUS

[75] Inventor: Raymond John Herbert, Leigh-on-Sea, United Kingdom

[73] Assignee: Neopost Limited, Essex, United Kingdom

[21] Appl. No.: 09/013,610

[22] Filed: Jan. 26, 1998

[30] Foreign Application Priority Data

Jan. 29, 1997 [GB] United Kingdom ..... 97018311

[51] Int. Cl.[6] ..... B41J 2/325

[52] U.S. Cl. ..... 400/120.01; 400/649

[58] Field of Search ..... 400/120.01, 120.16, 400/120.17, 192, 185, 649; 347/171, 197, 198, 217

[56] References Cited

U.S. PATENT DOCUMENTS 5,337,661 8/1994 Goldberg ..... 400/120.16
5,536,092 7/1996 Yamaguchi ..... 400/649
5,718,522 2/1998 Kang ..... 400/185

FOREIGN PATENT DOCUMENTS 2226794A 7/1990 United Kingdom .
2251216A 7/1992 United Kingdom .

*Primary Examiner*—Edgar Burr
*Assistant Examiner*—Amanda B. Sandusky
*Attorney, Agent, or Firm*—Shoemaker and Mattare Ltd

[57] ABSTRACT

Thermal transfer printing apparatus is provided with a driven impression roller movable into an operative position to urge a print receiving medium into engagement with an ink layer of an ink transfer ribbon and the ribbon into heat transfer engagement with a thermal print head. Rotation of the impression roller feeds the ribbon and print receiving medium past the print head. A drive roller for a ribbon take-up drive is located so as to be engaged directly by the impression roller or by the print receiving medium when the impression roller is in the operative position so as to impart drive to the ribbon take-up.

5 Claims, 2 Drawing Sheets

FIG. 2
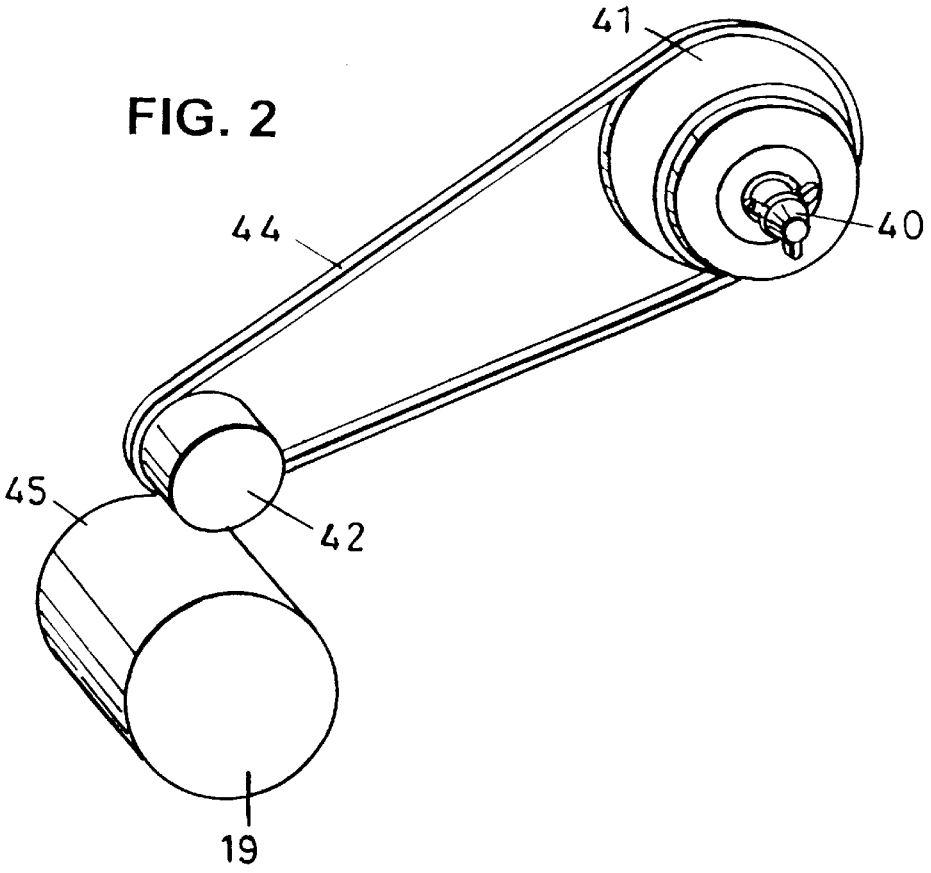
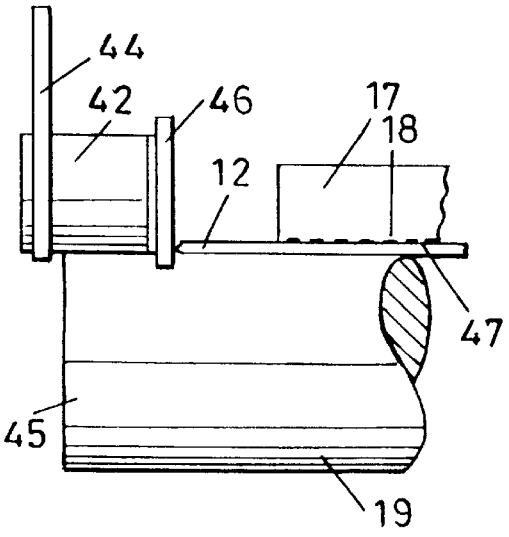
FIG. 3
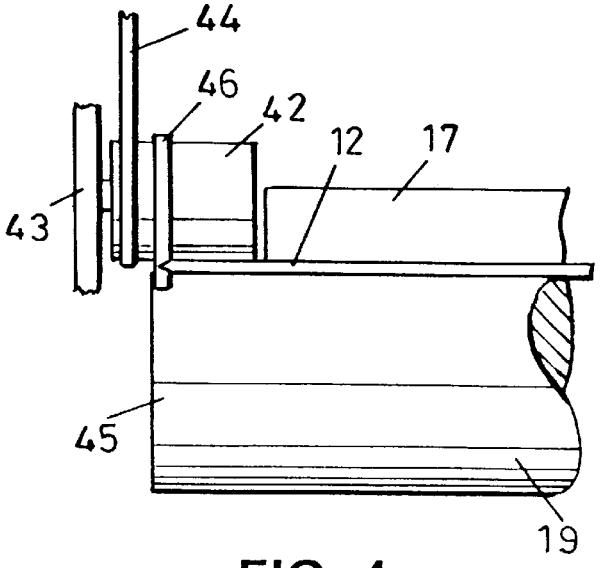
FIG. 4

THERMAL TRANSFER PRINTING APPARATUS

BACKGROUND OF THE INVENTION

This invention relates to thermal transfer printing apparatus in which ink is transferred from a thermal transfer ink ribbon to a print receiving medium by selective energisation of thermal printing elements of a thermal print head.

In thermal transfer printing apparatus, the thermal transfer ink ribbon is interposed between the thermal printing elements and the print receiving medium. The thermal transfer ink ribbon includes an ink layer carried on a ribbon substrate and the thermal transfer ink ribbon is orientated with the ink layer of the ribbon in contact with the print receiving medium. The print receiving medium is fed by feeding means past the thermal printing elements of the print head and, as a result of frictional engagement between the ink layer of the ribbon and the print receiving medium, the ink layer of the ribbon adheres to the print receiving medium and thereby the ribbon is drawn with the print receiving medium as the print receiving medium is fed past the print head. The thermal printing elements are disposed in a line extending transversely to the direction of feeding of the print receiving medium and are selectively energised by an electric current to cause heating of the printing elements to transfer ink from the ink layer to the print receiving medium. After passing the print elements, the used ribbon is peeled from the print receiving medium and is wound onto a take-up spool by driving the take-up spool. Usually the drive to the take-up spool is provided by means of a dedicated electric drive motor controlled to impart sufficient tension to peel the ribbon from the print receiving medium.

SUMMARY OF THE INVENTION

According to one aspect of the invention, the thermal transfer printing apparatus includes a thermal print head; said thermal print head including selectively energisable thermal print elements; a rotatable impression roller disposed in opposition to said thermal print elements; means to feed a print receiving medium past the thermal print head elements between the impression roller and the thermal printing elements; means to guide a supply of thermal transfer ink ribbon past the thermal print elements between the thermal printing elements and the print receiving medium; means to move the impression roller between an operative position adjacent the thermal printing elements and an inoperative position spaced away from the thermal printing elements; resilient means effective when the impression roller is in the operative position to urge the impression roller toward the thermal print elements thereby to urge the print receiving medium into ink transfer engagement with an ink layer of the ink ribbon and the ink ribbon into heat transfer engagement with the thermal print elements; and ribbon take-up drive means operable to peel the thermal ink ribbon from engagement with the print receiving means after passing the thermal printing elements; said impression roller when in the operative position being effective to apply drive to and thereby operate the ribbon take-up means.

According to another aspect of the invention a postage meter includes thermal transfer printing apparatus as hereinbefore defined.

BRIEF DESCRIPTION OF THE DRAWING

An embodiment of the invention will be described hereinafter by way of example with reference to the drawings in which:

FIG. 2 illustrates a drive mechanism for a ribbon take-up spool of the thermal transfer printing apparatus of FIG. 1, FIG. 3 is a part elevational view of the drive mechanism of FIG. 2, and FIG. 4 is a part elevational view similar to FIG. 3 but illustrating a modification of the drive mechanism.

DESCRIPTION OF THE PREFERRED EMBODIMENT

Figure 1:
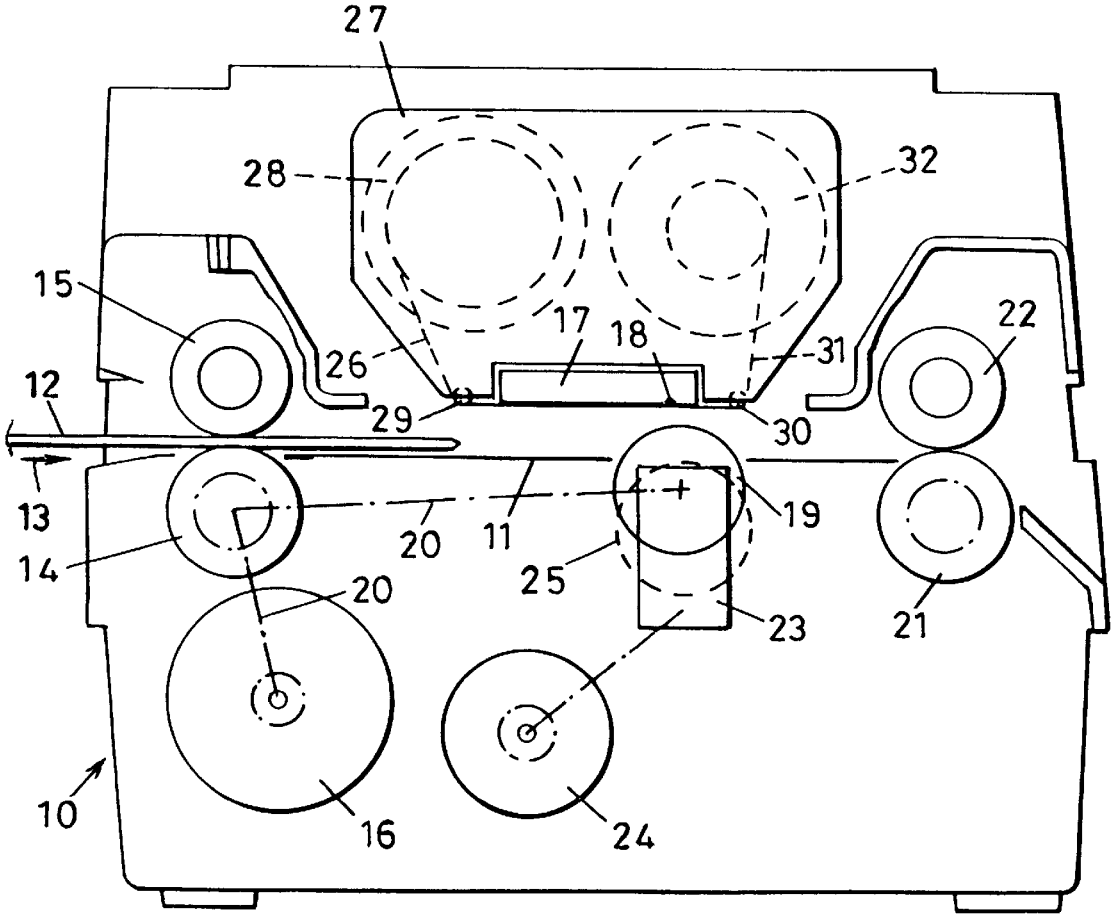
FIG. 1 illustrates a construction of postage meter utilising thermal transfer printing apparatus in accordance with the invention.

Referring first to FIG. 1, a postage meter includes a housing and chassis 10 having a feed bed 11 extending horizontally therethrough along which a print receiving medium comprising a mail item 12 can be fed, in the direction of arrow 13, to receive an imprint of a postage indicium. A pair of input rollers 14, 15, of which roller 14 is driven by a motor 16 and roller 15 is an idler roller, are located at an upstream end of the feed bed to receive a leading edge of the mail item 12 and feed the mail item along the feed bed 11 toward a thermal print head 17. The thermal print head is provided with a line of thermal printing elements (the location of the line being indicated by reference 18) extending transversely relative to the length of the feed bed 11. An impression roller 19, driven by the motor 16 is located in opposition to the line of thermal printing elements of the thermal print head 17. Broken lines 20 indicate mechanical drive transmissions, for example pulleys and belts or trains of gear wheels, whereby drive is transmitted from the drive motor 16 to the input roller 14 and to the impression roller 19. A pair of ejection rollers 21, 22 are mounted at a downstream end of the feed bed, the roller 21 being driven by drive means (not shown) and the roller 22 being an idler roller. The ejection rollers receive the mail item after the leading edge of the mail item has passed the print head and, after completion of printing an imprint on the mail item, the mail item is ejected from the postage meter by the ejection rollers.

The input roller 14, the impression roller 19 and the ejection roller 21 extend through apertures in the feed bed 11 such that the peripheral surfaces of these rollers project slightly above the feed bed so as to engage mail items 12 to be fed along the feed bed 11. The impression roller is mounted in a cradle 23 and a cradle drive motor 24 is mechanically coupled to the cradle 23 to move the cradle and the impression roller mounted thereon from an inoperative position to operative position. The cradle may be released from the operative position, or may be driven by the cradle drive motor to the inoperative position. In the operative position, the impression roller is located a shown in FIG. 1 and extends through an aperture in the feed bed so as to project from the feed bed and is resiliently urged toward the print head 17. In the inoperative position, the impression roller is located in a retracted position as indicated by broken line 25 such that the periphery of the impression roller is spaced from the print head 17 to permit mail items to pass freely between the impression roller and the print head.

Printing is effected by thermal transfer of ink from a layer of ink of an ink ribbon 26 contained in a replaceable ribbon cassette 27. A supply of unused ink ribbon is provided wound on a supply spool 28 and is guided by a roller guide 29 to pass, out of the cassette, across the print head between the thermal printing elements of the print head and the mail item 12. After passing the print head 17, the used ribbon is guided by a further roller guide 30 back into the cassette and the used ribbon 31 then is wound onto a take-up spool 32. The ink ribbon comprises a substrate carrying on a front face thereof a layer of ink. During passage of the ribbon between the print elements and the mail item, a rear face of the substrate lies adjacent the thermal printing elements and the ink layer is exposed to be engaged by the surface of a mail item. When printing is taking place the mail item is maintained in intimate engagement with the ink layer and the ribbon is maintained in heat transfer relationship with the thermal printing elements of the print head, in a region adjacent the thermal printing elements, by means of the impression roller 19 when in the operative position. The engagement of the ink layer of the ribbon by the mail item and the feeding of the mail item by the impression roller 19 causes the ribbon to be drawn past the thermal printing elements at the same speed as and in synchronism with the feeding of the mail item.

During passage of the mail item together with the thermal ink ribbon past the thermal printing elements, selective energisation of the thermal printing elements effects heating of areas of the ink layer adjacent the energised elements and thereby causes those areas of the ink layer to adhere more strongly to the surface of the mail item than the remainder of the ink layer.

After passing the print head, the ribbon is peeled from the mail item leaving those areas of the ink layer which have been subjected to heating by energised ones of the printing elements adhered to the mail item. Thus by selectively energising the thermal printing elements in each of a series of printing cycles as the mail item and ribbon are fed past the thermal printing elements, areas of the ink layer are caused to adhere to the mail item to form a required printed impression on the mail item.

Peeling of the used ribbon from the mail item is effected by applying tension to the used ribbon. This tension is generated as a result of torque applied to the take-up spool 32 to wind the used ribbon onto the take-up spool.

Upon completion of printing of the required impression on the mail item the impression roller is retracted from the operative position to the inoperative position and as a result the mail item is released from engagement with the ink layer of the ink ribbon. Therefore the mail item is free to be ejected from the postage meter by the ejection rollers and the ink ribbon is no longer subjected to a force tending to feed ribbon past the print head from the supply spool. Accordingly the ribbon is only fed with the mail item while printing is taking place and ribbon is not wasted as would be the case if the impression roller is maintained in the operative position continuously. It will be appreciated that because the ribbon is fed from the supply spool only for a period sufficient to enable printing to be effected, the take-up spool is required to be rotated to wind on used ribbon only during the period of printing. Usually the torque is applied to the take-up spool by means of a take-up motor controlled such as to ensure that tension of sufficient magnitude is applied to the used ribbon to ensure that the used ribbon is peeled from the mail item and also to ensure that the ribbon is not drawn from the supply spool during periods in which the ribbon is not engaged by a mail item and printing is not occurring. The take-up motor is controlled by electronic circuits in a manner such as to ensure the required take-up of the used ribbon.

In accordance with the present invention torque to drive the take-up spool is obtained from the drive motor 16 that drives the impression roller and the requirement for a separate take-up motor and control electronics therefor is eliminated. A drive for the take-up spool is illustrated in FIGS. 2 to 4 to which reference will now be made.

A rotatable shaft carrying a drive dog 40 is located on the chassis of the postage meter as to enable the drive dog to be engaged by and transmit drive to the take-up spool 32. A pulley 41 is secured to the drive shaft to transmit drive to the drive shaft. A drive roller 42 is rotatably mounted on a support member 43 and is located to the rear of the print head. The peripheral surface of the roller is adjacent to the line of printing elements 18 as illustrated in FIG. 3. A drive belt 44 provides a mechanical transmission to transmit drive from the roller 42 to the pulley 41 and thence to the drive dog 40. The impression roller 19 has an extension 45 thereof extending beyond the print head to the rear of the print head and, when the impression roller is raised into the operative position, as shown in FIG. 3, the extension 45 of the impression roller makes driving engagement with the roller 42. As explained hereinbefore with reference to FIG. 1 of the drawings, the impression roller is driven and when printing is to be effected the impression roller is raised into the operative position to engage and feed a mail item past the print head along the feed bed. Accordingly when printing is to be effected, the extension 45 of the driven impression roller engages the drive roller 42 and thereby imparts drive to the drive roller 42 and via the belt 44, the pulley 41 and the drive dog 40 to the take-up spool 32 engaged with the drive dog 40. When printing is not occurring and the impression roller is retracted to its inoperative position, the engagement of the extension 45 with the drive roller 42 is terminated and drive to the take-up spool is terminated. Therefore it will be appreciated that drive is applied to the take-up spool 32 only when the impression roller is in the operative position during periods in which printing is to be effected. In order to accommodate the need for rotation of the drive spool at a speed which varies as the diameter of the wound ribbon increases a slipping clutch may be incorporated between the drive pulley 41 and the drive dog 40.

As shown in FIG. 3, a guide 46 for an edge of the mail item 12 is located such that the mail item is guided to pass between the print head 17 and the impression roller 19 but not to pass between the extension 45 of the impression roller and the drive roller 42. It will be appreciated that the spacing of the impression roller 19 from the line of printing elements is determined by the thickness of the mail item and hence it is necessary to ensure that, with a range of thicknesses of mail items to be fed through the postage meter, the extension 45 of the impression roller always drivingly engages the drive roller 42 such as to transmit drive to the drive roller 42. The entire length of the impression roller may be resiliently deformable to an extent sufficient not only to accommodate variations of thickness of a mail item but also to ensure driving engagement between the extension 45 and the drive roller 42 for a range of thicknesses of mail item. Alternatively the extension 45 may include or comprise an annular element resiliently deformable to a greater extent than that part of the impression roller opposed to the print elements of the print head to ensure driving engagement between the annular element and the drive roller 42. If desired the drive roller 42 may be resiliently deformable. Preferably the drive roller is located such that the peripheral surface of the drive roller extends slightly lower, as seen in FIG. 3, than the underneath face 47 of the print head. In an alternative construction the support element 43 may be pivoted about an axis of the pulley 41 and resiliently urged to move the drive roller toward and into engagement with the extension 45 of the impression roller.

Hereinbefore the drive roller 42 is described as being located to the rear of the print head above the feed bed 11.

However if desired the drive roller may be disposed at other locations provided that movement of the impression roller into the operative position results in driving engagement between the impression roller and the drive roller and that movement of the impression roller into the inoperative position results in termination of said driving engagement.

In a modified drive for the take-up spool shown in FIG. 4 the mail guide 46 is located such as to allow the mail item 12 to pass between the drive roller 42 and the extension 45 of the impression roller. Accordingly, the extension 45 urges the mail item into engagement with the drive roller 42 and the drive roller 42 is driven by engagement thereof by the mail item. Since the drive roller 42 is driven by engagement with the surface of the mail item the drive roller may be located so that the periphery thereof is aligned with the lower surface of the print head. Because the mail item extends between the impression roller and the printer head as well as between the impression roller and the drive roller the extension 45 of the impression roller is spaced from the drive roller to the same extent, provided the mail item is of uniform thickness, so that the impression roller is spaced from the print head. Accordingly the resilient mounting of the impression roller accommodates a range of different thicknesses of mail item between the impression roller and the print head as well as between the extension 45 of the impression roller and the drive roller 42. Accordingly the impression roller and extension thereof may be uniformly resiliently deformable.

I claim:

1. Thermal transfer printing apparatus including a thermal print head; said thermal print head including selectively energisable thermal print elements; a rotatable impression roller disposed in opposition to said thermal print elements; means to feed a print receiving medium past the thermal print head elements between the impression roller and the thermal printing elements; means to guide a supply of thermal transfer ink ribbon past the thermal print elements between the thermal printing elements and the print receiving medium; means to move the impression roller between an operative position adjacent the thermal printing elements and an inoperative position spaced away from the thermal printing elements; resilient means effective when the impression roller is in the operative position to urge the impression roller toward the thermal printing elements thereby to urge the print receiving medium into ink transfer engagement with an ink layer of the ink ribbon and the ink ribbon into heat transfer engagement with the thermal print elements; and ribbon take-up drive means operable to peel the thermal ink ribbon from engagement with the print receiving means after passing the thermal printing elements; said impression roller when in the operative position being effective to apply drive to and thereby operate the ribbon take-up means.

2. Thermal printing apparatus as claimed in claim 1 wherein the ribbon take-up means includes a rotatable drive element and said impression roller when in the operative position engaging said rotatable drive element to rotate said drive element and thereby apply drive to the ribbon take-up means.

3. Thermal printing apparatus as claimed in claim 1 wherein the ribbon take-up means includes a rotatable drive element and said impression roller when in the operative position being effective to urge the print receiving medium into driving engagement with the drive element whereby the feeding of the print receiving medium rotates the drive element of the ribbon take-up means.

4. Thermal printing apparatus as claimed in claim 2 wherein the ribbon take-up means includes a rotatable ribbon take-up spool and the drive means includes drive transmission means to transmit drive from the rotatable drive element to the take-up spool.

5. Thermal printing apparatus as claimed in claim 4 wherein the transmission means includes a slipping clutch.

* * * * *